US008074745B2

(12) United States Patent
Paul et al.

(10) Patent No.: US 8,074,745 B2
(45) **Date of Patent: *Dec. 13, 2011**

(54) TOOL FOR CRUSHING COKE

(75) Inventors: Wolfgang Paul, Bad Schwartau (DE); Maciej Barcikowski, Bochum (DE); Dirk Heidemann, Schwerte (DE); Mathias Ozimek, Witten (DE)

(73) Assignee: Ruhrpumpen GmbH, Witten (DE)

( * ) Notice: Subject to any disclaimer, the term of this patent is extended or adjusted under 35 U.S.C. 154(b) by 351 days.

This patent is subject to a terminal disclaimer.

(21) Appl. No.: 11/578,456

(22) PCT Filed: Apr. 8, 2005

(86) PCT No.: PCT/EP2005/003727

§ 371 (c)(1), (2), (4) Date: Aug. 8, 2007

(87) PCT Pub. No.: WO2005/105953

PCT Pub. Date: Nov. 10, 2005

(65) Prior Publication Data

US 2008/0067858 A1 Mar. 20, 2008

(30) Foreign Application Priority Data

Apr. 21, 2004 (DE) ..... 10 2004 020 013

(51) Int. Cl.
*B08B 3/00* (2006.01)

(52) U.S. Cl. ..... 175/317; 137/625.31

(58) Field of Classification Search ..... 137/625.3, 137/625.31, 865, 625.46; 134/167 R, 167 C, 134/168 R, 168 C; 175/324, 393, 317
See application file for complete search history.

(56) References Cited

U.S. PATENT DOCUMENTS

| | | | | |
|---|---|---|---|---|
| 3,804,186 | A * | 4/1974 | Schoeffler | 175/317 |
| 4,923,021 | A | 5/1990 | Courmier et al. | |
| 5,816,505 | A * | 10/1998 | Tran et al. | 239/443 |
| 2002/0005299 | A1 * | 1/2002 | Estep et al. | 175/57 |

FOREIGN PATENT DOCUMENTS

| | | | |
|---|---|---|---|
| DE | 3941953 | A1 | 6/2009 |
| SU | 1120693 | A1 | 5/1985 |
| SU | 1234414 | A2 | 5/1986 |
| WO | WO 03014261 | A1 * | 2/2003 |

* cited by examiner

*Primary Examiner* — Sunil Singh
(74) *Attorney, Agent, or Firm* — Bachman & LaPointe, P.C.

(57) ABSTRACT

A tool for crushing coke includes a casing which in the operational state is connected to a drill rod and on or in which is arranged at least one cutting nozzle and one drill nozzle for drilling coke and at least one valve for controlling a direction of flow of water flowing through the drill rod and the casing through the cutting nozzle and the drill nozzle.

24 Claims, 7 Drawing Sheets

TOOL FOR CRUSHING COKE

BACKGROUND (1) Field of the Invention

The invention relates to a tool for crushing coke, including a casing which, in the operational state is connected to a drill rod and on or in which at least one cutting nozzle each for cutting and one drill nozzle for drilling of coke and at least one valve for controlling a direction of flow of the water flowing through the drill rod and the casing through the cutting nozzle and the drill nozzle is arranged.

(2) Background Art

In oil refineries the last, otherwise no longer usable fraction of the crude oil is converted into coke. The conversion is brought about by feeding this fraction into drums which, as the operation proceeds, become filled with coke. Once the maximum filling level of the drums has been attained, the coke is cut out of the drums.

This so-called "de-coking" is conventionally performed with high pressure water jets which crush the coke and flush it out of the drums. The tool for generating these high pressure water jets is introduced by way of a drill rod mechanism from above into the drum. The "de-coking" is performed in two steps. To begin with, an aperture is drilled by the tool in the drum, then the tool is, once again, taken to the upper end of the drum and the coke is now crushed by high pressure water jets generated by the cutting nozzles approximately at about right angles to the axis.

The tool which is, for example, known from WO 03/14261 A1 representing the genus, is accordingly designed for two operating conditions, firstly for the drilling of an aperture which is necessary for moving the tool and for the subsequent discharge of crushed coke and, secondly, for the cutting of the coke across the cross section of the drum. Accordingly, the drill nozzles direct high pressure water jets essentially parallel or at an acute angle to an axis, which is formed by the drill rod and by the aperture formed during drilling. The cutting nozzles, on the other hand, generate high pressure water jets which are directed essentially at right angles or at a shallow angle to the axis formed by the drilling rod and the aperture in the drum.

The change-over between the operational states of drilling and cutting must proceed rapidly and simply. The nozzles which are used in the tool, due to the high water pressure, suffer wear and tear and must be replaced at regular intervals. Accordingly, the tool must be so designed that a replacement of the nozzles can be performed rapidly and reliably.

The wear and tear of the nozzles is increased by the fact that in known tools of the afore mentioned type, water under high pressure is forced into an annular space which communicates with all nozzles, from where the water enters non-directionally into whichever nozzles are opened, in the course of which no reorientation whatsoever of the flow in the direction of the respective nozzles takes place.

In another tool as well, known from DE 39 41 953 A1 the feeding of water under pressure to the cutting nozzles and to the drill nozzles proceeds initially in a central piston and from there, depending on the position of the piston in the casing of the tool, through apertures traversing the wall of the piston into one or two annular cavities of which one is connected to the cutting nozzles and the other is connected to the drill nozzles. The pressurized water flow is subjected in the piston to vortex formation and, only after having suffered corresponding pressure and flow losses, passes by way of the apertures in the wall of the piston into radial ducts in which the water is conducted to the nozzles.

In the tool known from U.S. Pat. No. 5,816,505 as well, two annular cavities of this type are provided to each of which the pressurized water is conducted, as a function of a control bringing about either the drilling mode of operation or the cutting mode, with considerable flow losses and forwarded from the respective annular cavity by way of ducts connected there to the nozzles.

SUMMARY OF THE INVENTION

The invention has as an object to provide a tool for crushing coke which has a particularly simple design as well as permitting reliable insertion and maintenance.

The invention attains this object by means of a tool in accordance with claim 1. Advantageous further developments of the inventive concept are reflected in the dependent claims.

Characteristic features of the tool according to the invention are at least two flow passages formed inside the casing, which respectively extend between individual feed apertures associated with the respective drill passage and the respective cutting and drilling nozzles. The valve for controlling the direction of flow of the water to the cutting nozzles or the drilling nozzles respectively, is, in this context, accommodated in the region of the feed apertures, and, depending on the prevailing operating conditions, generally cutting or drilling, closes the corresponding feed apertures of the individual flow passages.

The flow passages which, within the scope of the invention, represent individually separated regions, extending between the feed apertures and the outlet apertures provided in the region of the associated nozzles, permit the feeding of the water with only very low flow losses in a directed manner to the respective nozzles. As a result of the thereby achieved reduction of the disturbing effects acting on the nozzles, the life expectancy of the individual nozzles, as compared with conventional tools, can be increased substantially.

This minimizing of the flow losses as well as the optimizing of the flow within the tool, in addition, permits feeding the water through the tool with a supply pressure, which is lower than with known tools whilst maintaining the same discharge pressures from the valves.

Accordingly, the design according to the invention also permits increasing the life expectancy of the components which act in conjunction with the tool such as, e.g., a supply pump, due to the reduction of the pumping output.

A further advantage of the tools according to the invention results from the circumstance that the feed apertures which are closable for regulating the direction of flow of the water, can be combined at an optional, constructionally advantageous locality of the tool, so that even a plurality of mutually independently arranged nozzles can be controlled using a single valve.

Accordingly, the employment of a multitude of valves, as are particularly required when using a plurality of nozzles, which preferably have to be arranged in a single plane, can therefore be dispensed with so that the tool in accordance with the invention can be manufactured in a very compact form and at low cost, and, moreover, has a particularly simple construction.

Depending on the design of the valve and the arrangement of the feed apertures it is possible, in principle, to control the direction of flow of the water by the tool in an optional manner.

By being adapted to the predominating purpose of using the tool, this is in an advantageous manner designed for the two operational states of cutting and drilling, in the operational state of cutting, the feed apertures to the drilling nozzle and in the operational state of drilling, the feed apertures to the cutting nozzle being closed by the valve.

This further development of the invention permits reducing the number of valve bodies in the valve required for the closing of the feed apertures, such that the valve can be designed particularly simply, this resulting, in particular, in a further reduction of the manufacturing costs and an increase of the functional reliability of the tool, additionally to the afore going The arrangement of the flow passages as well as of the feed apertures in the tool can be freely selected subject to constructional and hydrodynamic preconditions.

According to a further development of the invention, the feed apertures are, however, arranged essentially normal to the direction of flow of the water flowing through the drill rod and the casing. In this context the direction of flow will, as a rule, correspond to the longitudinal axis of the tool and of the drill rod, so that the flow apertures then extend transversely to the longitudinal axis of the tool.

This further development of the invention permits a particularly compact design of the tool. More particularly, the constructional space requirements of the tool transversely to its longitudinal axis are reduced, because the valve bodies, in contrast to known tools, need no longer be arranged immediately adjoining the nozzle and, therefore, between the nozzle and the interior of the tool. Moreover, the twisting forces arising when readjusting the valves is reduced considerably as compared with known tools.

If constructional considerations permit, the flow passages may be formed in one piece with the casing. However, a simplification of the manufacture is attained according to an advantageous embodiment of the invention in that the flow passages are formed as an installation module to be installed in the casing.

The arrangement of this module is preferably so brought about that no water will bypass between the module and the inner wall of the casing, which might otherwise have adverse effects on the main flow. This is preferably brought about by a non-positive or positive connection of between the module and the casing of the tool with the aid of screws or the like.

In that respect it is unnecessary in designing the flow passages to take the configuration of the casing of the tool into consideration, so that the flow passages which, according to a further development of the invention, has a hydro dynamically optimized configuration, preferably follow a rounded-off pattern, the cross section of the flow passages according to a particularly advantageous further development, being optionally designed in the desired manner such that it changes from the feed aperture to the cutting and/or drilling nozzles.

The use of a separate installation module moreover makes it possible to employ therefore a material which differs from the material for the casing and which is particularly suitable for the construction of the flow passages but, because of possibly higher cost, is only used to a limited extent for the manufacture of the casing.

An additional improvement of the flow through the casing may be attained in that at the end of the flow passages facing the nozzles, flow unifiers are provided which improve the flow performance of the water through the nozzles in a supplementary manner.

The valve for controlling the flow through the feed apertures may, in principle, comprise optionally designed valve bodies. According to an advantageous further development of the invention, however, the valve comprises valve bodies which, at least in sections, are of spherical configuration which close the feed apertures according to the particularly elected operational state.

The spherical configuration of the surface sections ensures that the entry to the respective feed apertures to be closed, are securely sealed against the passage of liquid. A circularly shaped disc, one side of which is spherically convex would, for example, entirely satisfy the requirements of closing the feed apertures.

Accordingly to a particularly advantageous further development of the invention the valve bodies, however, include at least two spherical surface sections and are preferably of symmetrical design. As a rule, these spherical surface sections are, in this context, provided on opposite sides, e.g. as spherical caps which are mutually adjoining along their maximum circumferences. The symmetrical design of the valve bodies offers the advantage that, because of their symmetrical design, they can be easily guided in the valve. On the other hand, they offer the advantage that, in the event of a first spherical surface section having suffered some wear, the symmetrical valve body can simply be turned around. Whenever that happens, another spherical cap with a second spherical surface section can now be used for sealing the feed apertures.

As compared with spheres serving as valve bodies which, according to a further advantageous embodiment of the invention, may likewise be used, and in which, because of the complete symmetry, any positional securing of the valve body can be dispensed with, the symmetrical valve bodies are to be given preference whenever the diameter of the valve body directly affects the dimensions of the tool, because such valve bodies have a lesser thickness than spherical valve bodies.

According to a first embodiment the valve is accommodated in the interior of the casing and comprises means for guiding, in particular half shells which embrace the valve body when these are in engagement with the feed apertures.

The means for guiding these valve bodies are accommodated in the valve where the latter, however, as a rule, does not fill the casing entirely. Accordingly, clearances are present between the valve and the casing. According to an advantageous further development of the invention these clearances communicate with the interior of the tool so that the liquid which, in operation flows through the tool may also flow through these clearances. The advantage of this arrangement is that no pressure drop prevails in the tool between the interior and the clearances between the casing and the valve. Accordingly, the valve can be designed in a material-saving manner, because no pressure differences leading to corresponding compressive and tensile forces need to be accommodated. In addition to this, the avoidance of pressure differences ensures the smooth performance of the valve.

The arrangement of the valve, may, in a preferred manner, be such that the valve bodies are automatically pressed by the internal pressure prevailing in the casing on to the feed apertures to be closed. According to an advantageous further development of the invention, the valve bodies, however, are biased by a spring element in the direction towards the feed aperture. This further development of the invention improves in a supplementary manner the functional reliability of the valve and ensures in a particularly reliable manner that the valve bodies will enter into engagement with the particular selected feed apertures and close in a liquid-tight manner.

The switch-over from the operational state "drilling" to the other operational state "cutting" takes place manually in most prior art tools. After the first processing step the tool is withdrawn from the drum and a device fitted inside the tool is actuated which, after conclusion of the drilling step process, closes the downwardly directed drilling nozzles and opens the cutting nozzles.

This device for the closing of individual or a plurality of nozzles, on the one hand, is in engagement with the valve, and on the other hand provides an aperture for accommodating an operating element which is to be actuated from the outside of the tool. In order to avoid accidents when operating the decoking tool, the device for operating the valve, in accordance with an advantageous further development of the invention, is provided in that region which faces towards the drilling rod, that is to say above the nozzles, so that even in the event of failure of any control- and warning devices, the operating personnel can approach the tool without the risk of serious injuries arising.

BRIEF DESCRIPTION OF THE DRAWINGS

In the following a working example of the invention will be described with reference to the drawings. Dependent claims relate to an advantageous embodiment of the invention. In the drawings there is shown in FIG. 1 a first sectional view in longitudinal direction of an embodiment of the tool according to the invention in the operating condition "drilling";

DETAILED DESCRIPTION OF THE PREFERRED EMBODIMENT(S)

Figure 1:
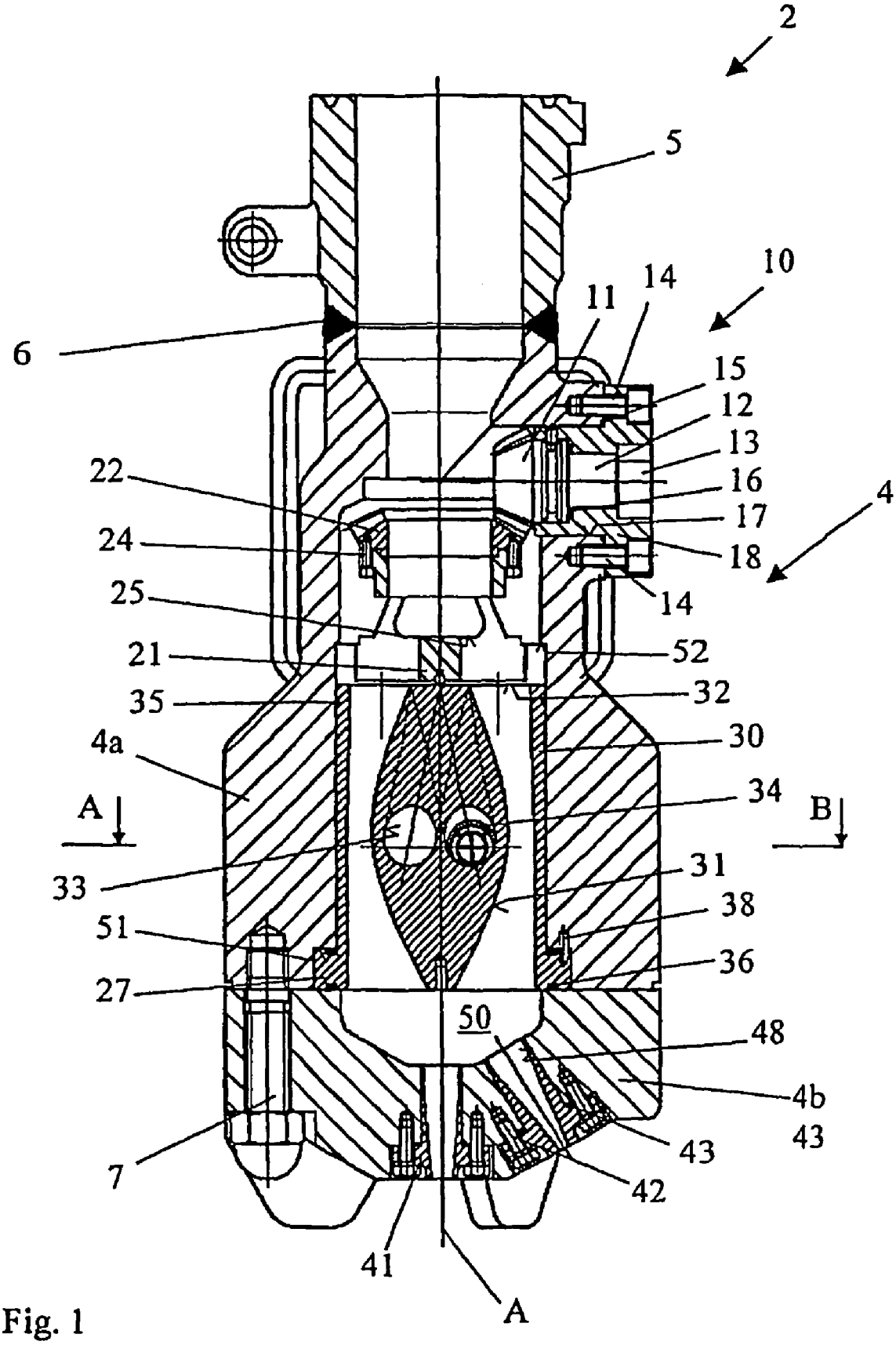
Figure 4:
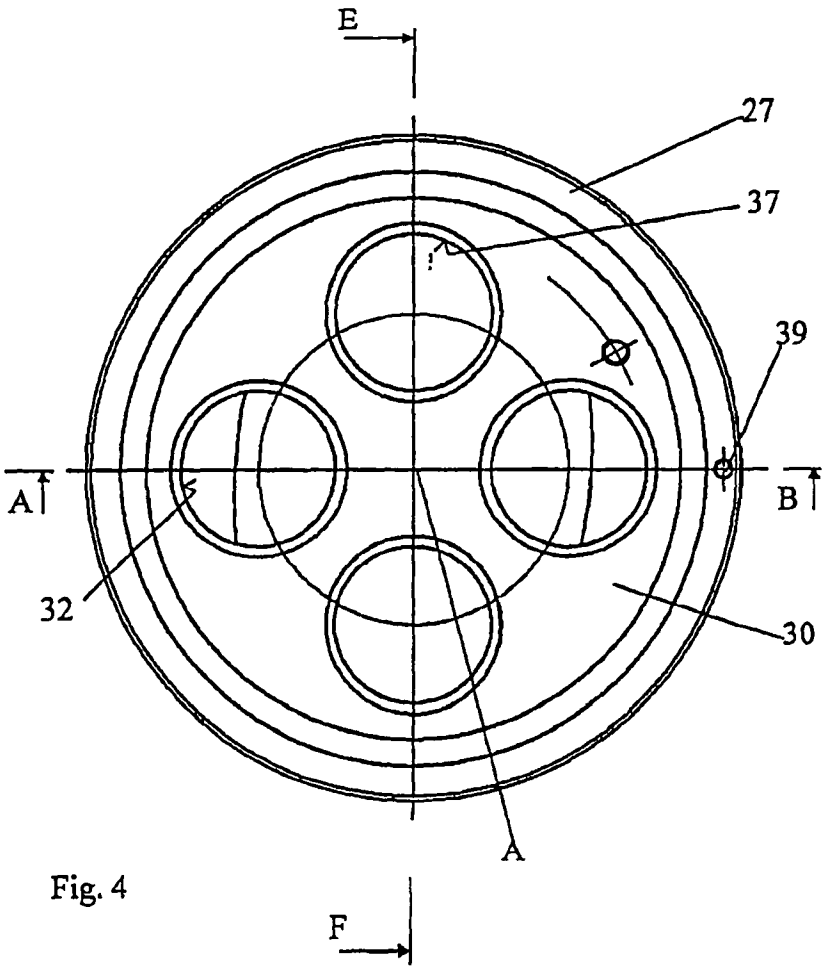
FIG. 4 a plan view on to an assembly module of the tool according to FIG. 1 for the accommodation of flow passages.
Figure 7:
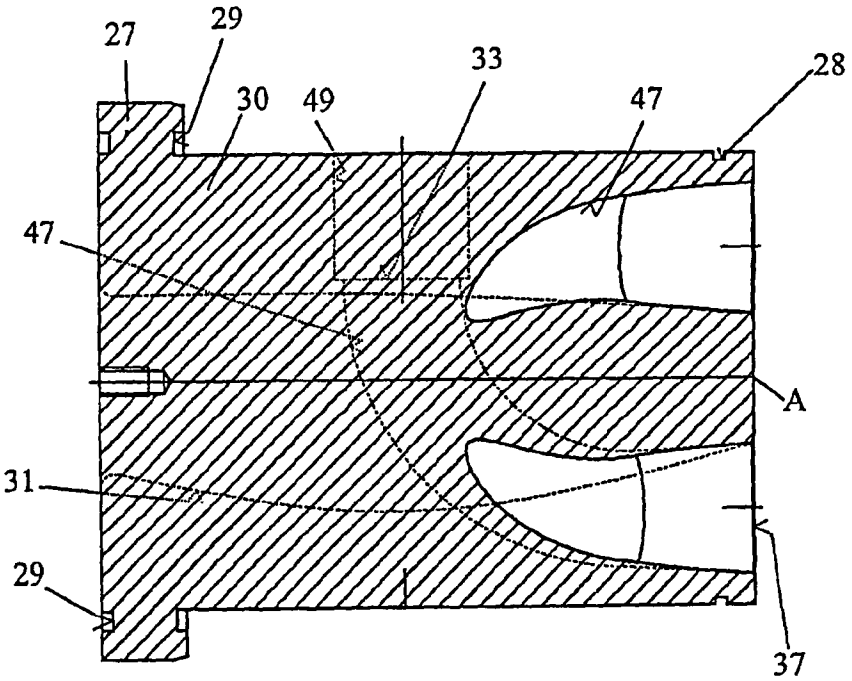
FIG. 7 a sectional view of the module according of FIG. 4 along the section line E-F of FIG. 4.
Figure 6:
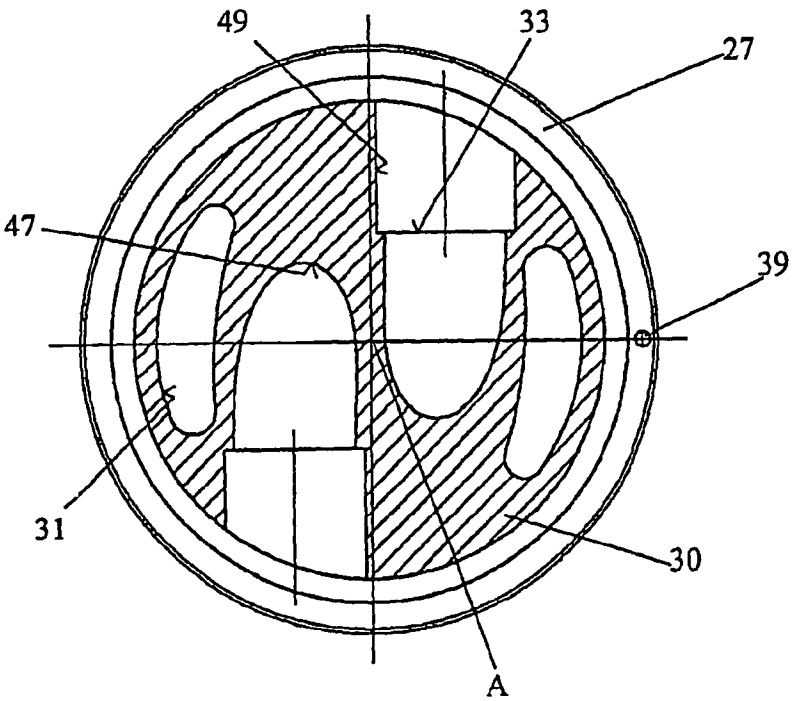
FIG. 6 a sectional view of the module according to FIG. 4 along the section line C-D according to FIG. 5.
Figure 10:
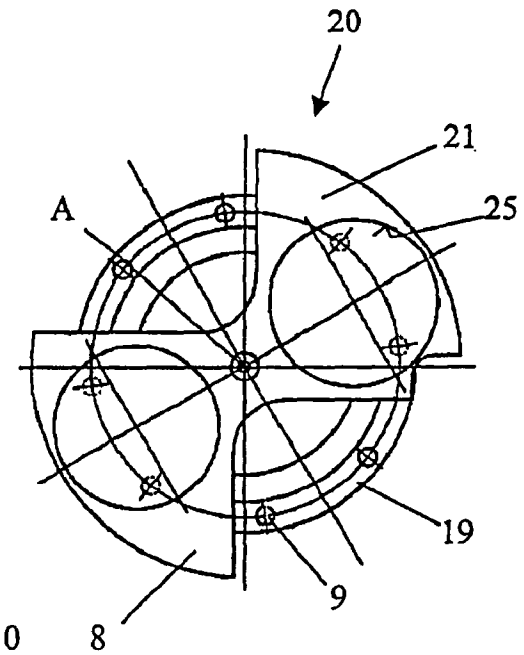
FIG. 10 a reversed plan view of FIG. 8.
Figure 9:
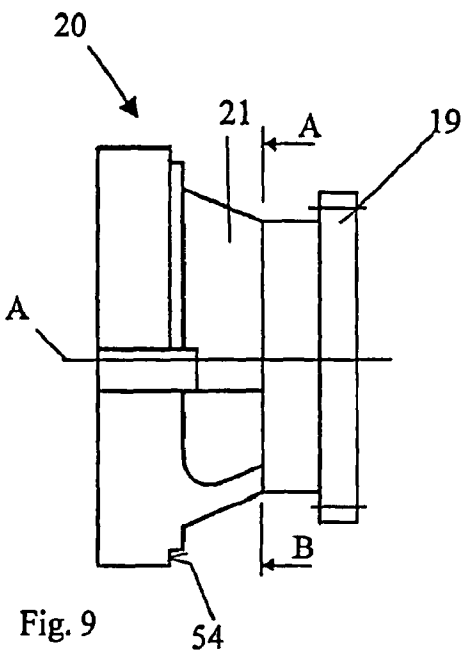
FIG. 9 a front elevation of the valve according to FIG. 8.
Figure 8:
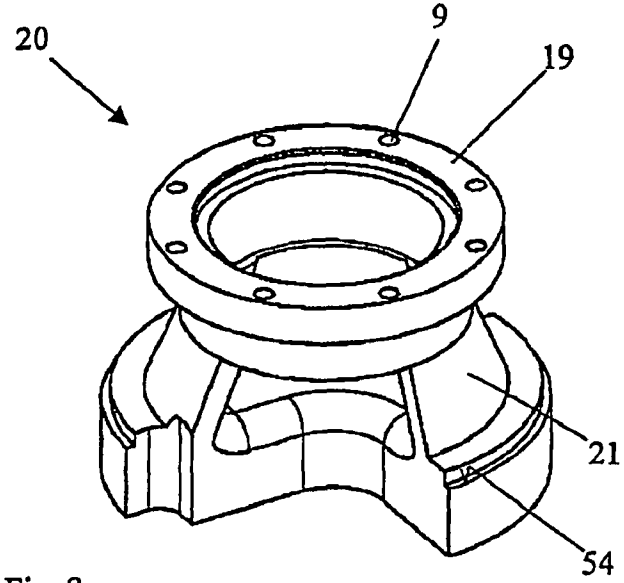
FIG. 8 a perspective view of a valve of the tool according to FIG. 1.
Figure 12:
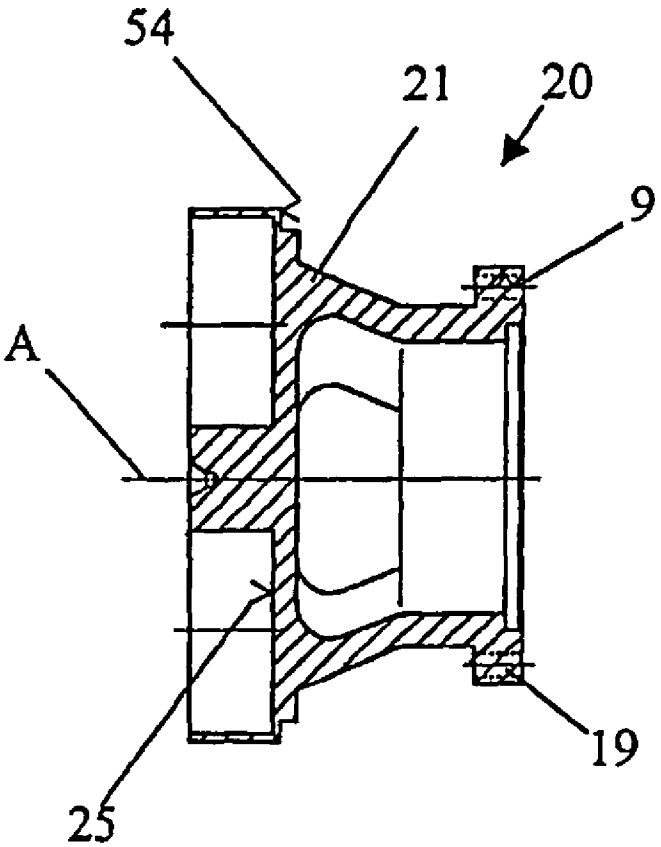
Figure 11:
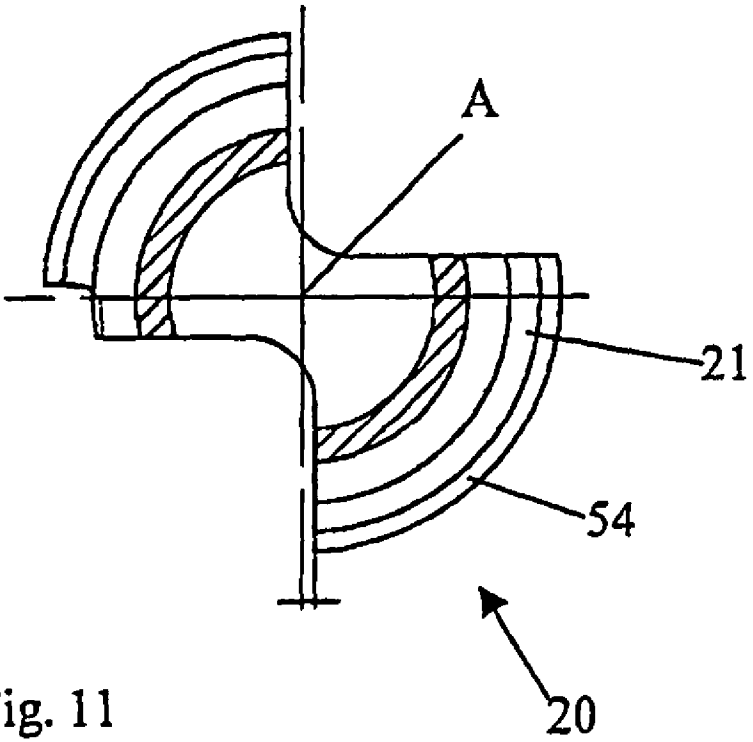
FIG. 11 a sectional view of the valve according to FIG. 8 along the section line A-B of FIG. 9 and FIG. 12 a sectional view of the valve according to FIG. 8 along the section line C-D of FIG. 10.

FIG. 1 shows a tool 2 including a casing 4, four nozzles 34, 41—two nozzles 41 for the drilling of coke, two nozzles 34 for the cutting of coke—of which only two have been illustrated, an assembly module 30 comprising four flow passages 31, 47, as well as a valve 20 for opening and closing of feed apertures 32, 37 (see FIG. 4) provided in the module 30.

In its operational state the tool 2 is suspended from a drill rod which is not shown in detail and is introduced into a drum filled with coke. References such as "top" or "bottom" relate to the longitudinal axis A which is aligned with the drill rod (top) and a bore (bottom; not illustrated) generated by the tool 2, in the context of the tool 2 illustrated in FIGS. 1 and 3, as well as the components illustrated in FIGS. 2 and 4 to 12.

The casing 4 is constructed in two parts and is composed of the upper casing half 4*a* and the lower casing half 4*b* which are interconnected with the use of screws 7 extending through the lower casing half 4*b* and engaging threaded bores in the upper casing half 4*a*.

A cavity 50 in the lower casing half 4*b* ensures the unimpeded liquid flow through the flow passages 31 to the drilling nozzles 41, which are accommodated in corresponding bores 48 in the lower casing half 4*b* and are secured in their position by screws 42. An annular gasket 43 provided in the region of the contact areas of the drilling nozzles 41 against the bore 48 serve to seal the interior of the tool 2 against the environment.

The upper casing half 4*a* is fitted by way of a flange 5 with inter-insertion of an annular gasket 6 in a liquid-tight manner to the drill rod. The upper casing half 4*a* from there extends as an essentially cylindrical hollow body to the lower casing half 4*b*. At the end of the upper casing half 4*a* which faces the lower casing half 4*b*, a circular shoulder 51 is formed. At this shoulder 51 a module 30 provided in the lower region of the upper casing half 4*a* adjoins the upper casing half 4*a* by way of a flange 27.

Annular gaskets 36 for sealing the interior and for sealing the connection of the lower casing half 4*b* and the upper casing half 4*a* are accommodated in correspondingly configured grooves 29 (see FIG. 5) against the upper and lower side of the flange 27. A gasket 35 is inserted into an annular groove 28 provided in the upper region of the module 30 and seals the installation of the module 30 in the upper casing half 4*a* in its upper region.

On the upper side of the flange 27 a bore 39 for accommodating a positioning pin 38 is furthermore provided which, in the installed position of the module 30 in the upper casing half 4*a*, is partly accommodated in a corresponding bore in the upper casing half 4*a*.

The module 30 illustrated in FIGS. 4-7, as a separate component, includes at its end directed towards the drill rod, four feed apertures 32, 37, each provided staggered by 90° on the circular end of the module 30. Two mutually opposite feed apertures 32, 37 respectively lead to the cutting nozzles 34, or to the cavity 50 preceding the drill nozzles 41.

Viewed in the direction of flow, the feed apertures 32 constitute the beginning of two flow passages 47 which follow an arcuate course and which terminate at outlet apertures 33 provided ahead of the cutting nozzles 34 provided diametrically on the tool 2. For fitting the cutting nozzles 34 to the outlet apertures 33, the module 30 in the region behind the outlet apertures 33—likewise viewed in the direction of flow—shows a correspondingly configured receiving aperture 49. The cutting nozzles 34 as such are fitted in corresponding bores 45 in the upper casing 4*a* and are secured by screws 46.

The feed apertures 37—viewed in the direction of flow—constitute the commencement of two further flow passages 31 which extend separately and mutually opposite towards the cavity 50. The flow passages 31 in this context have a rounded cross-section which, from the feed apertures 37 to the cavity 50, first constricts and then extends again. The sectional view illustrated in FIGS. 3 and 6 in the plane of the cutting nozzles 34 shows the locality of the approximately smallest cross-section of flow passages 31.

Above the module 30 the valve 20 is accommodated rotatably in the upper portion of the casing 4*a*. The valve 20 in this context abuts with an annular shoulder 54 on its peripheral surface against a correspondingly configured contact area 52 in the upper portion of the casing 4*a* and is thereby fixed in the direction towards the drill rod (see FIGS. 8-12).

At its end, facing towards the module 30, the valve casing 21 takes the form of a cylindrical hollow body into which is formed a half shell support 8 extending essentially at right angles to the longitudinal axis of the tool 2. The half shell support 8 includes two oppositely positioned half shells 25 for accommodating valve bodies 26, the half shells 25 embracing the valve bodies 26 in the upper region in order to secure the positions of the valve bodies 26 in the radial direction of the tool 2.

The valve bodies 26 are of disc-shaped configuration and have mutually opposite spherical surface segments which match the configuration of the feed apertures 32, 37.

The half shell support 8 itself is of such configuration that, in a plane transverse to the longitudinal axis of the casing 4, two mutually opposite regions adjoining the half shells 25 are each opened up in an angular region of about 90° for the flow through the valve 20.

Starting from the half shell support 8 the valve casing 21 includes a circular section of upwardly constricting configuration which is followed by an annular flange 19 of cylindrical configuration, comprising for its connection to a conical gear 22 eight bores 9 designed for accommodating screws 24 extending through the bores 9 into correspondingly formed threads in the conical gear 22, whereby the latter is firmly connected to the valve casing 21.

The tool 2 illustrated in FIG. 1 is shown in the operational state "drilling" (drilling situation). In the drilling situation the valve bodies 26 of the valve 20 block the feed apertures 32 of the module 30. The diameter of the valve body 26 is, in this context, so dimensioned that feed apertures 32 are covered reliably and completely.

At the same time, the feed apertures 37 of the module 30 are freely accessible. Water which rushes under high pressure from the drill rod into the tool 2 flows through the interior in the tool 2 above the valve 20 through the latter and through the feed apertures 37 as well as the flow passages 31 following thereon, thereafter passing through the cavity 50 in the lower casing half 4*b* in order to eventually emerge through the bore nozzles 41 into a drum filled with coke, which is not actually illustrated.

In order to permit switching from the drilling situation to the operational condition "cutting", an operating device 10 is provided for operating the valve 20 in the tool 2. The operating device 10 includes, normal to the axis A extending through the upper casing half 4*a*, a shaft 12 at the end of which, positioned inside the tool 2, a conical gear 11 is provided, which engages the conical gear 22 on the upper side of the valve 20. At the end opposite to the gear 11 the shaft 12 comprises a tool receiving aperture 13 designed for accommodating a manual lever by means of which the shaft 12 and the conical gear 11 can be turned. The shaft 12 itself is pivotally mounted in a fitting 18, which is fixed in a bore 17 in the upper casing half 4*a* by means of an annular seal 15 and by screws 14 extending through the fitting 18 into the upper casing half 4*a*. Moreover, a further seal 16 seals the shaft 13 in the fitting 18.

For changing from the drilling state to the operational state of "cutting", the conical gear 11 is actuated by turning the shaft 12 and with the aid of the manual lever fitting the tool receiving aperture 13. The valve 20 engaging the gear 11 by way of the gear 22 is turned by the gear 11 in the upper casing half 4*a* about the axis A. Jointly with the valve casing 21 the conical gear 22 is rotated and thereby also the valve body 26 of the valve 20.

By turning the valve 20 on the upper end of the module 30, the valve bodies 26 which previously closed the feed apertures 32 to the flow passages 47 leading to the cutting nozzles 34, are opened up. When operating the tool receiving aperture 13, the valve bodies 26 are moved along a circular trajectory by 90° until the feed apertures 37 are totally closed.

Figure 2:
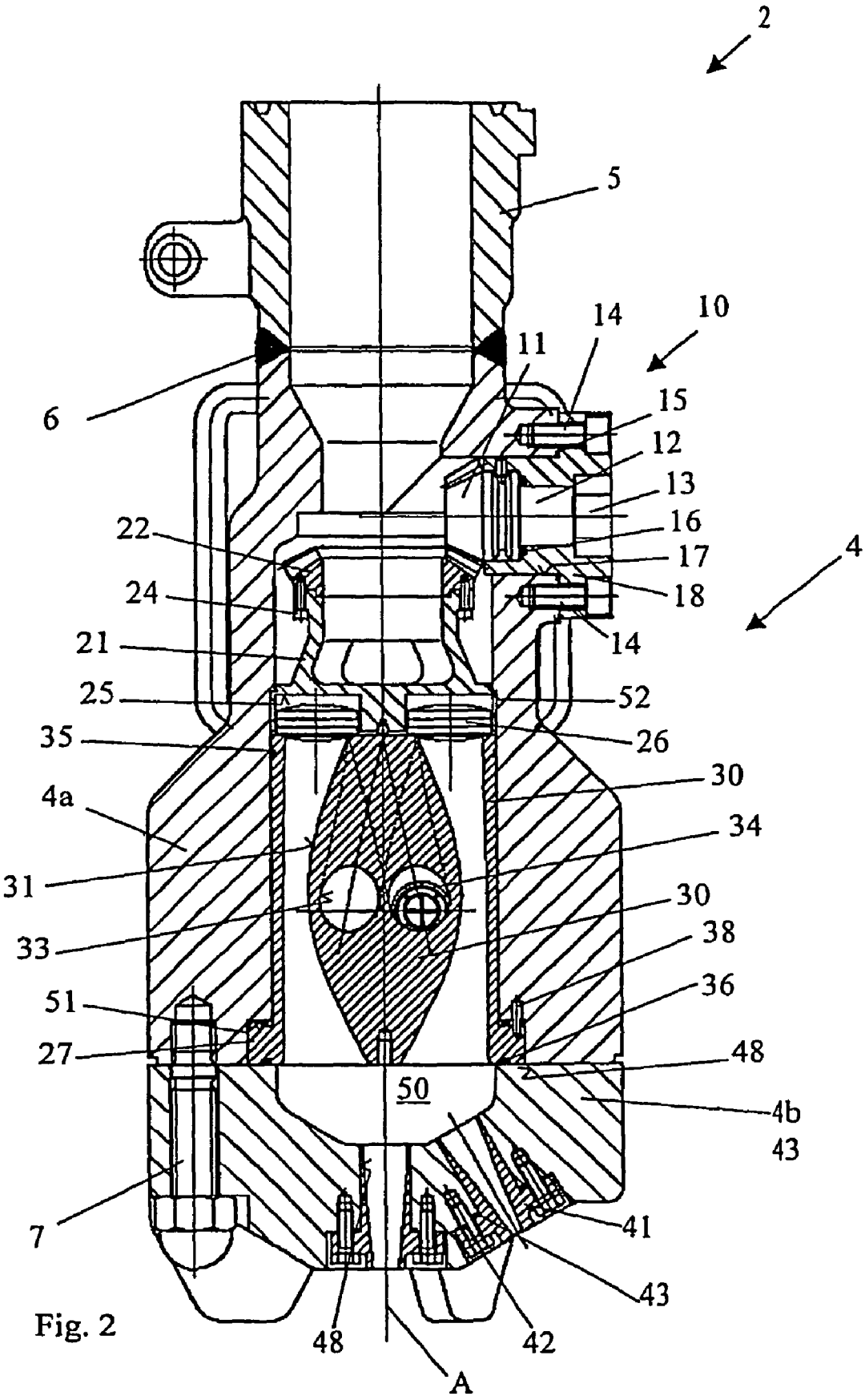
FIG. 2 a second sectional view in longitudinal direction of the tool according to FIG. 1 in the same section plane in the operative condition "cutting"
Figure 3:
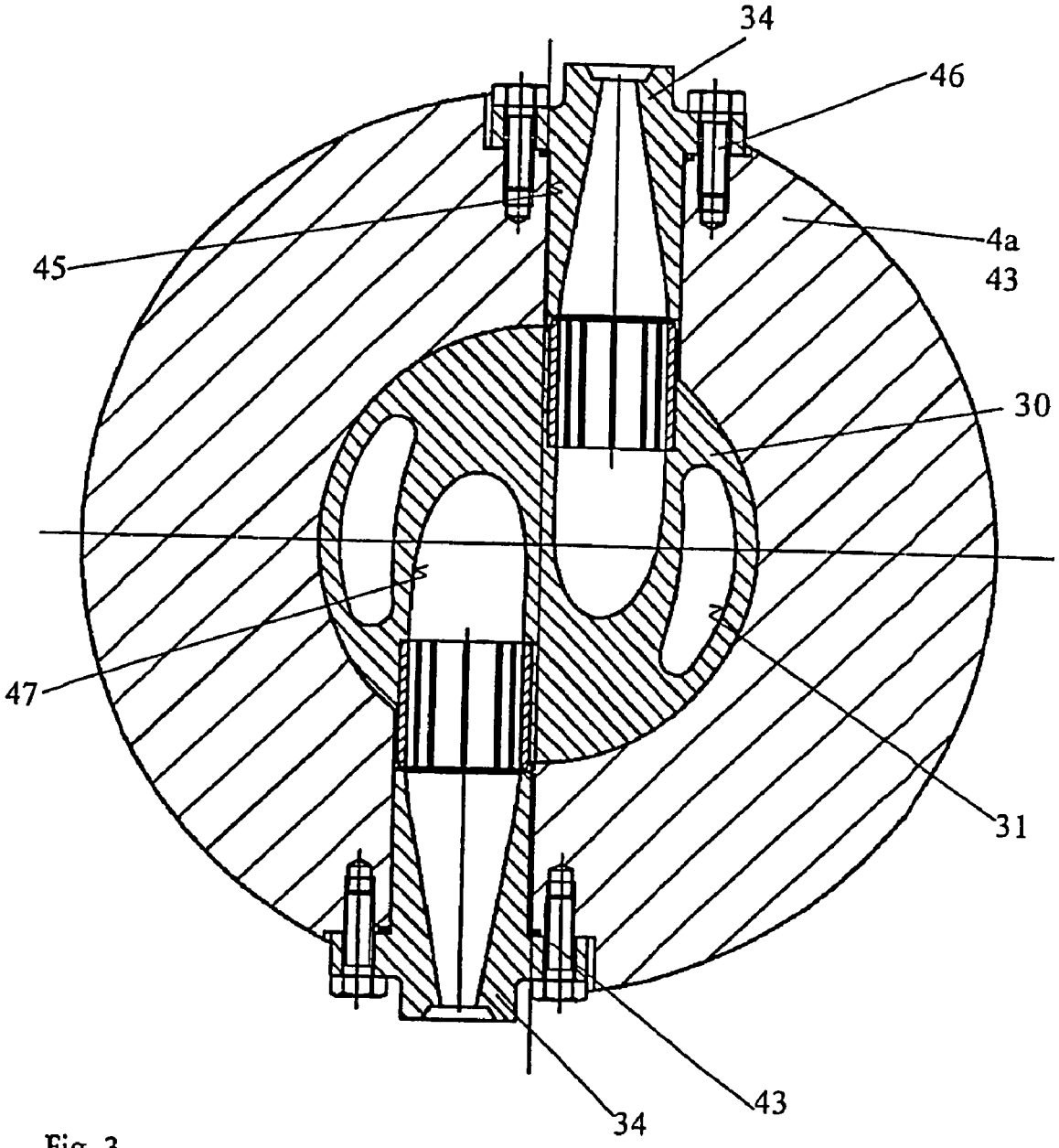
FIG. 3 a sectional view of the tool according to FIG. 1 along the section line A-B of FIG. 1.
Figure 5:
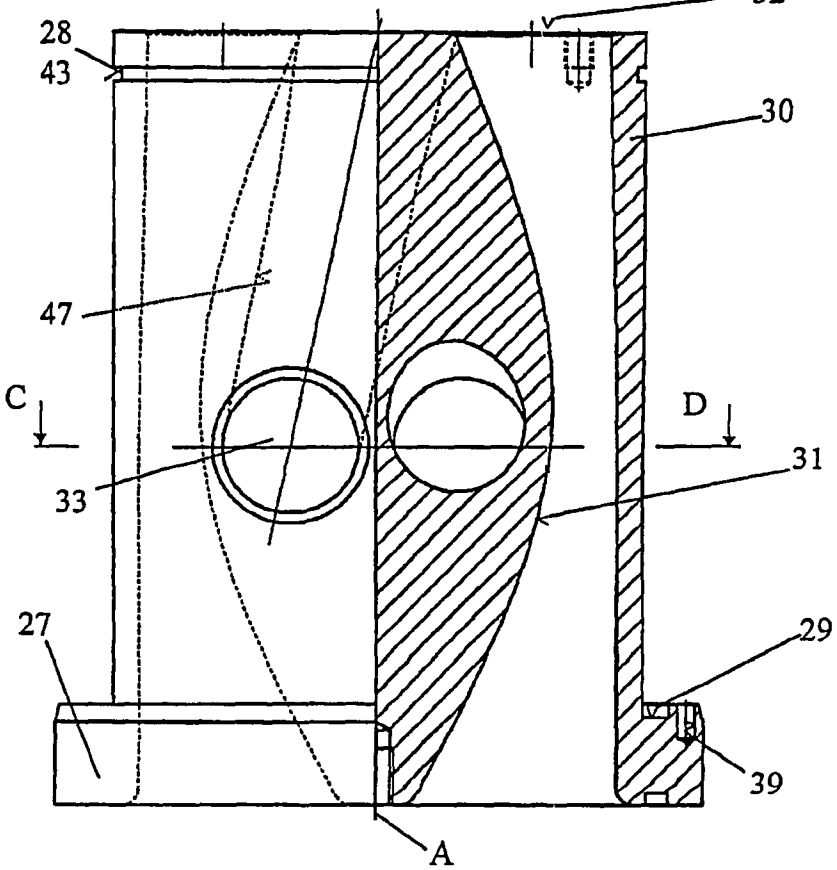
FIG. 5 an elevation, half of which is in section of the module according to FIG. 4 along the section line A-B of FIG. 4.

FIG. 2 shows the tool 2 in the operational state of cutting. Water under high pressure rushes from the drilling rod into the interior of the upper casing half 4*a* and now emerges through the feed apertures 32 into the flow passages 47 and thereafter, through the cutting nozzles 34. The feed apertures 37 are securely and completely closed by the valve bodies 26 provided there above. The closing action of the valve bodies 26, in this position as well as during closing the feed apertures 32, is secured in that the extremely high water pressure which is well in excess of 100 bar, forces the valve bodies 26 into the feed apertures 32, 37.

The invention claimed is:

1. Tool for crushing coke, including a casing which, in an operational state is connected to a drill rod;

at least one cutting nozzle for cutting of coke and at least one drill nozzle for drilling of coke;

at least one valve for controlling a direction of flow of water flowing through the drill rod and the casing through the at least one cutting nozzle and through the at least one drill nozzle;

at least two flow passages within the casing;

each said flow passage respectively forming closed-off regions and being associated individually with a feed aperture and each said flow passage extending respectively between the associated feed aperture and one of the cutting nozzle and the drill nozzle; and the at least one valve closing and opening the feed apertures and being provided in an inlet of the casing in a region of the feed apertures, wherein in the operational state of cutting, the feed aperture to the drilling nozzle is completely closed by the at least one valve and in the operational state of drilling, the feed aperture to the cutting nozzle is completely closed by the at least one valve.

2. Tool according to claim 1, wherein the feed apertures are essentially in an orientation normal to the direction of flow of the water flowing through the drilling rod and the casing.

3. Tool according to claim 1, wherein the flow passages are formed in a module installable into the casing.

4. Tool according to claim 1, wherein the flow passages are provided with a hydrodynamically optimized configuration.

5. Tool according to claim 1, wherein the flow passages have a rounded contour.

6. Tool according to claim 1, wherein a cross-section of the flow passages varies from the feed aperture to the cutting nozzle and/or the drilling nozzle.

7. Tool according to claim 1, wherein flow unifying means are provided at the end directed towards the nozzles of the flow passages.

8. Tool according to claim 1, wherein said at least one valve includes at least segmentery arcuately configured valve bodies which close the feed apertures, depending on the respective operational state.

9. Tool according to claim 8, wherein the valve bodies include at least two arcuate surface segments.

10. Tool according to claim 9, wherein the valve bodies are of symmetrical configuration.

11. Tool according to claim 8, wherein the valve bodies are in engagement with half shells which embrace the valve bodies.

12. Tool according to claim 8, wherein the valve bodies are in engagement with means for guiding same.

13. Tool according to claim 1, wherein said at least one valve is a ball valve, such that the feed apertures are each closable by a respective ball of the ball valve.

14. Tool according to claim 1, wherein said at least one valve is in engagement with a device for operating the at least one valve for changing between the diverse operational states.

15. Tool according to claim 1, further comprising at least two nozzles for cutting and two nozzles for drilling, each of the cutting and drilling nozzles being fitted in bores of the casing and being respectively connected by way of a flow passage to the respective feed apertures arranged normal to the drill rod and the feed apertures to the cutting nozzles being closed, whenever the tool is in the operating state of drilling and the feed apertures to the drilling nozzles being closed, whenever the tool is in the operational state of cutting.

16. Tool according to claim 1, wherein said at least one valve includes a valve body configured for closing one of the feed apertures depending on a respective operational state.

17. Tool for crushing coke, including:

a casing which, in an operational state is connected to a drill rod;

at least one cutting nozzle for cutting of coke and at least one drill nozzle for drilling of coke;

at least one valve for controlling a direction of flow of water flowing through the drill rod and the casing through the at least one cutting nozzle and through the at least one drill nozzle;

at least two flow passages within the casing;

each said flow passage respectively forming closed-off regions and being associated individually with a feed aperture and each said flow passage extending respectively between the associated feed aperture and one of the cutting nozzle and the drill nozzle;

the at least one valve closing and opening the feed apertures and being provided in an inlet of the casing in a region of the feed apertures; and the at least one valve is in engagement with a device for shifting the at least one valve for changing between diverse operational states, wherein in the operational state of cutting, the feed aperture to the drilling nozzle is completely closed by the at least one valve and in the operational state of drilling, the feed aperture to the cutting nozzle is completely closed by the at least one valve.

18. Tool according to claim 17, wherein the shifting device for shifting the at least one valve comprises a shaft at an end of which, positioned inside the tool, is a first gear which engages a second gear on an upper side of the at least one valve.

19. Tool according to claim 18, wherein the shaft of the shifting device extends normal to an axis through an upper casing half and the second gear on the upper side of the at least one valve and the first gear at the end of the shaft are each conical gears engaging each other.

20. Tool according to claim 19 wherein the shaft of the shifting device is pivotably mounted in a fitting which is fixed in a bore in a sealed manner in the casing.

21. Tool according to claim 19, wherein at its outer end, the shaft of the shifting device comprises a tool receiving aperture designed for accommodating a manual lever by means of which the shaft and the first conical gear can be turned.

22. Tool according to claim 18, wherein the second gear is connected to an upper free end of a rotatable valve casing of the at least one valve.

23. Tool according to claim 22, wherein the rotatable valve casing includes a circular section of upwardly constricting configuration which is followed by an angular flange of cylindrical configuration being connected to the second gear at the upper end of the valve casing.

24. Tool according to claim 17, wherein above a module, the at least one valve is accommodated rotatably in the upper portion of the casing and that the at least one valve in this context has an axially fixed position.

* * * * *